United States Patent [19]

Haigh

[11] Patent Number: 4,787,120

[45] Date of Patent: Nov. 29, 1988

[54] DOOR HINGE ASSEMBLY

[75] Inventor: Peter Haigh, Palm Beach, Australia

[73] Assignee: Ryde Glass Company Pty. Limited, Australia

[21] Appl. No.: 65,601

[22] Filed: Jun. 23, 1987

[30] Foreign Application Priority Data

Jun. 30, 1986 [AU] Australia ..... 59392/86

[51] Int. Cl.[4] ..... E05F 1/04; E05F 1/06

[52] U.S. Cl. ..... 16/317; 16/318; 16/337

[58] Field of Search ..... 16/277, 297, 303, 312, 16/317, 318, 337, 378

[56] References Cited

U.S. PATENT DOCUMENTS 3,648,327 3/1972 Edeus ..... 16/317

*Primary Examiner*—Nicholas P. Godici
*Assistant Examiner*—Edward A. Brown
*Attorney, Agent, or Firm*—Lowe, Price, LeBlanc, Becker & Shur

[57] ABSTRACT

A door pivot assembly comprising two portions. One portion is attached to a support beam for the door and has a vertical cylindrical pivot bearing and horizontal bearing surface. A V-shaped groove is formed on the bearing surface defining the closure plane of the door. The second portion of the assembly is attached to the door and has a pin for engaging the cylindrical bearing of the first portion. A V-shaped rib is provided on the first portion extending normal to the pin and at an angle to the door closure plane. This rib engages the groove of the first portion when the door is closed and biases the door towards a closed position.

4 Claims, 1 Drawing Sheet

DOOR HINGE ASSEMBLY

The present invention relates to door pivot assemblies. It has been developed primarily for use on glass shower-screen doors but is generally applicable to any door intended to lie in a predetermined plane in its closed position.

Known assemblies, whilst being satisfactory in some respects, have been susceptible to excessive deterioration with wear and subsequently fail to maintain a unique door closure position.

It is an object of the present invention to overcome or at least ameliorate the abovementioned shortcoming of the prior art by simple means.

According to the invention there is provided a door pivot assembly comprising a base portion adapted for attachment to a support beam; said base portion including a vertically directed cylindrical pivot bearing; a horizontally extending bearing surface; and a V-shaped groove extending across said bearing surface, defining the closure plane of said door; said assembly further comprising a pivot portion, adapted for attachment to a door, having a pin projecting therefrom engageable with said bearing, a V-shaped rib extending normally of said pin for complementary engagement with said V-shaped groove formed in said support member, said V-shaped rib extending at angle to said closure plane such that the door is biased towards a closed position on engagement of said rib with said V-shaped groove.

In a preferred embodiment, the pivot portion may include a U-shaped portion able to receive a pane of glass or other suitable door panelling.

Additionally, the base portion may include a load supporting surface adapted to abut a surface of the support beam, an upwardly directed tongue adapted to be received by an engagement formation of the support beam at one end thereof, and a downwardly directed flange adapted to be fastened at the other side of the support beam.

A preferred embodiment of the present invention will now be described by way of example only with reference to the accompanying drawings in which.

Figure 1:
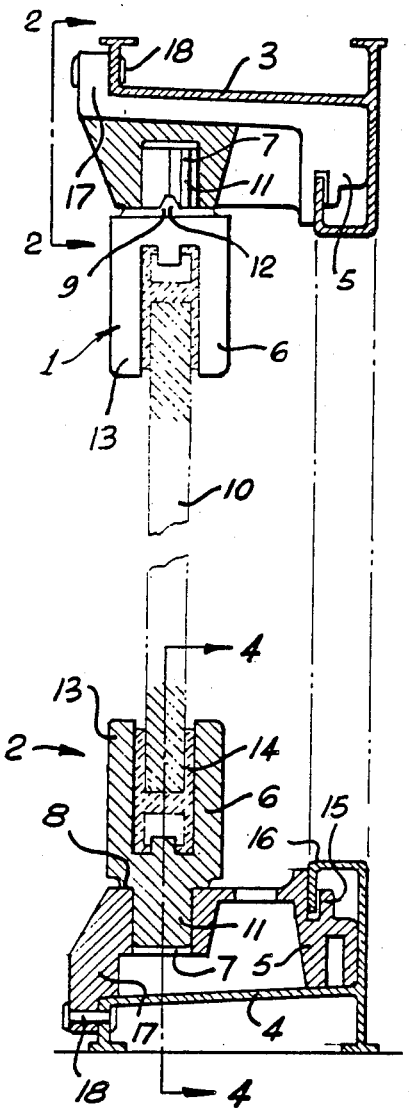
FIG. 1 is a partly sectioned side elevation of a pair of door pivot assemblies shown in situations.
Figure 2:
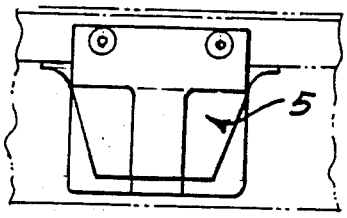
FIG. 2 is a view taken on line 2—2 of FIG. 1.
Figure 3:
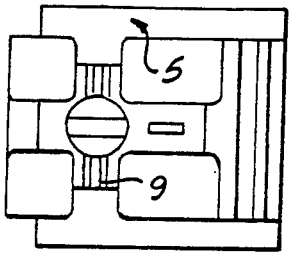
FIG. 3 is a plan view of the base portion of the assembly shown in FIG. 1.
Figure 4:
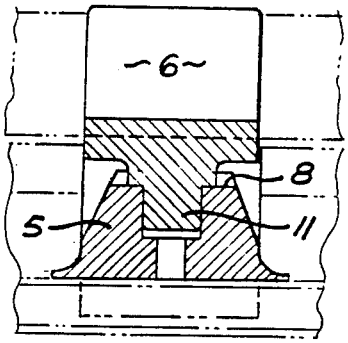
FIG. 4 is a view taken on line 4—4 of FIG. 1.

Referring first to FIG. 1, two pivot assemblies 1 and 2 are shown attached to upper support beam 3 and lower support beam 4 respectively.

Each of the pivot assemblies comprises a base portion 5 and a pivot portion 6. The base portion 5 includes a vertically directed cylindrical pivot bearing 7 and a horizontally extending bearing surface 8.

Figure 5:
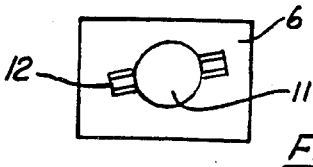
FIG. 5 is an underside view of the pivot portion of the assembly shown in FIG. 1.

A V-shaped groove 9 extends across the bearing surface 8 and intersects an axis defined by the pivot bearing 7, to define the closure plane of a door 10. Each of the pivot portions 6 comprises a pin 11 engageable with the pivot bearing 7 and a V-shaped rib 12 extending normally of the pin 11 and able to be received by the V-shaped groove 9. The rib 12 extends at an angle to the door closure plane, as shown in FIG. 5, so as to bias the door towards a closed position.

The pivot portion 6 includes a U-shaped portion 13 which is able to receive a pane of glass or other panel defining the door 10. A rubber seal 14 is provided to aid in the resilient clamping of the door 10 by the U-shaped portions 13.

The base portion is provided with formations which enable it to be easily attached to its support beam. These formations include an upstanding tongue portion 15 slidingly captured behind a mutually engaging downturned lip 16 of the support beam and a downwardly directed flange 17 which overhangs the front of the support beam and is fixedly attachable thereto by rivets 18 or any other suitable fastening means.

The apex of each of the V-shaped ribs has been flattened to allow the pivot assembly to operate smoothly without burring.

The pivot assembly 2 is attached to the lower support beam 4 and supports the lower edge of the door 10. The weight of the door is transferred from the pivot portion 6 to the base portion 5 via the V-shaped rib 12 to the horizontally extending bearing surface 8 or to the V-shaped groove 9. The pivot assembly 1 which is connected to the upper support beam 3 is provided with a clearance between the V-shaped rib 12 and the bearing surface 8.

When the door is in the closed position, the V-shaped rib 12 of the lower pivot assembly 2 is engaged with its respective groove 9. The angled rib causes the door to be biased towards a closed position so as to hold the door firmly against the door jamb in the closed position. Upon opening of the door 10, the V-shaped rib 12 is lifted from its groove 90 and up onto the bearing surface 8. This causes the door to lift and correspondingly causes the pin 11 of the upper pivot assembly to extend further into its pivot bearing 7.

When the door 10 is returned to its closed position, the V-shaped rib 12 drops back into its respective V-shaped groove 9 and the weight of the door holds it in this position providing a resistance to the opening of the door.

It will be appreciated by those skilled in the art that if the clearance provided in the upper pivot assembly 1 between the bearing surface 8 and the rib 12 is removed, flexure of the support beams 3 and 4 may provide an additional force to maintain the door in its closed position.

It will also be appreciated by those skilled in the art that whereas the pivot assembly has been shown bilaterally symmetrical, it could include right and left hand assemblies in which case the axis of rotation of the pivot portion with respect to the base portion could be closer to one edge thereof.

I claim:

1. A door pivot assembly comprising a base portion adapted for attachment to a support beam; said base portion including a load supporting surface adapted to abut a surface of said support beam, an upwardly directed tongue adapted to be received by an engagement formation of said support beam at one end thereof, and a downwardly directed flange adapted to be fastened at the other end of said support beam; said base portion including a vertically directed cylindrical pivot bearing; a horizontally extending bearing surface; and a V-shaped groove extending across said bearing surface, defining the closure plane of said door; said assembly further comprising a pivot portion, adapted for attachment to a door, having a pin projecting therefrom engageable with said bearing, a V-shaped rib extending normally of said pin for complementary engagement with said V-shaped groove formed in said support member, said V-shaped rib extending at an angle to said closure plane such that the door is biased towards a closed position on engagement of said rib with said V-shaped groove; said pivot portion including a U-shaped portion adapted to receive a pane of glass or other suitable door panelling.

2. A door assembly according to claim 1 wherein the apex of said V-shaped rib is flattened.

3. A door pivot assembly according to claim 1 wherein said support beam is adapted to flex during movement of said door between an opened and closed position such that said support beam applies a force to said bearing surface which resists movement of said door from its closed position.

4. A door pivot assembly according to claim 3 wherein the position of the axis of rotation of said pivot portion relative to said base portion is arranged to allow either a right or left hand opening assembly.

* * * * *